US008056758B2

(12) United States Patent
Burney

(10) Patent No.: US 8,056,758 B2
(45) Date of Patent: Nov. 15, 2011

(54) NON-CYLINDRICAL CONTAINER AND LID

(75) Inventor: Forrest A. Burney, Raleigh, NC (US)

(73) Assignee: BWAY Corporation, Raleigh, NC (US)

( * ) Notice: Subject to any disclaimer, the term of this patent is extended or adjusted under 35 U.S.C. 154(b) by 1277 days.

(21) Appl. No.: 11/676,530

(22) Filed: Feb. 20, 2007

(65) Prior Publication Data

US 2007/0205197 A1 Sep. 6, 2007

Related U.S. Application Data

(60) Provisional application No. 60/775,115, filed on Feb. 21, 2006.

(51) Int. Cl.
*B65D 41/16* (2006.01)

(52) U.S. Cl. ..... 220/792; 220/780; 220/790; 220/269

(58) Field of Classification Search ..... 220/269, 220/276, 780, 781, 790, 792
See application file for complete search history.

(56) References Cited

U.S. PATENT DOCUMENTS

| | | | | |
|---|---|---|---|---|
| 2,984,382 | A * | 5/1961 | Florsheim, Jr. | 220/784 |
| 4,673,087 | A * | 6/1987 | Webb | 206/600 |
| 4,735,337 | A * | 4/1988 | Von Holdt | 220/276 |
| 4,919,286 | A * | 4/1990 | Agbay, Sr. | 215/235 |
| 4,930,656 | A * | 6/1990 | Blanchette | 220/276 |
| 5,617,968 | A * | 4/1997 | Luburic | 220/276 |
| 5,641,090 | A * | 6/1997 | Kowalski et al. | 220/782 |
| 5,873,484 | A * | 2/1999 | Clute et al. | 220/276 |
| 6,273,291 | B1 * | 8/2001 | Conti | 220/781 |
| 6,279,774 | B1 * | 8/2001 | Clute et al. | 220/792 |
| 6,352,170 | B1 * | 3/2002 | Brown et al. | 220/782 |
| 7,086,551 | B2 * | 8/2006 | von Holdt, Jr. | 220/276 |
| 7,090,088 | B2 * | 8/2006 | von Holdt, Jr. | 220/276 |
| 7,207,457 | B2 * | 4/2007 | Schwarz | 220/276 |
| 7,475,788 | B2 * | 1/2009 | Schwarz | 220/276 |
| 2001/0010311 | A1 * | 8/2001 | Ciccone | 220/276 |
| 2005/0269339 | A1 * | 12/2005 | Ciccone | 220/795 |

* cited by examiner

*Primary Examiner* — Anthony Stashick
*Assistant Examiner* — Christopher McKinley
(74) *Attorney, Agent, or Firm* — Schnader Harrison Segal & Lewis LLP

(57) ABSTRACT

A rectangular container and cover are disclosed. The container and cover have complimentary latching feature. An inner cover skirt is offset inward toward the cover interior at each corner. The offset is sufficient to permit use of a moveable mold tooling to form each of the corners of the cover. This allows full formation of latching hooks extending around the entire interior of the skirt, such that when the cover is placed on the container the cover latching hooks engage with container latching ribs to secure the cover on the container. A tear strip is also disclosed, the removal of which leaves residual flaps at each sidewall intersection and at about the lateral center of each sidewall. A portion of the cover skirt remains affixed to the container when the tear strip is removed.

20 Claims, 3 Drawing Sheets

NON-CYLINDRICAL CONTAINER AND LID

This application is based on, and claims priority to, provisional application having Ser. No. 60/775,115, having a filing date of Feb. 21, 2006, entitled, Tri-lock Container and Lid.

BACKGROUND OF THE INVENTION

Square or rectangular containers allow maximum use of available pallet, shelving, and warehouse space and therefore are often preferred by manufacturers. However, because square or rectangular plastic containers and covers made from high density polyethylene (HDPE) or polypropylene (PP) have traditionally performed poorly in industry standard drop, stack, and leak tests, their use has generally been restricted to non-hazardous dry goods. This poor performance is primarily due to design constraints associated with the product shape. Latching features can be easily molded into the straight sidewalls, but the abrupt change in skirt direction at each of the four corners has historically prevented adequate latching features from being molded at these locations. Traditionally, covers are stripped out of a mold. The typical square or rectangular covers, however, cannot be so stripped at the corner because the radius is too small. The compensations necessary result in weakened corners for latching purposes and lead to leakage problems. Accordingly, there is a need for a container and lid system with a superior leak control design that can be used for square or rectangular containers.

SUMMARY OF THE INVENTION

Embodiments of the present invention provide a rectangular, or other angular cross sectional profile container and cover. In an illustrative embodiment of the invention, the container has three latching ribs and a tear strip retention rib disposed on its exterior. A rectangular cover is provided that is complimentary to the container, such that when the cover is placed on the container at least a portion of the cover sidewalls extends outside of the container sidewalls and a portion of the cover extends into the inside of the container. The portion extending inside the container sidewalls includes an inner cover skirt offset inward toward the cover interior at each corner. The offset is sufficient to permit use of a moveable mold tooling to form each of the corners of the cover. This allows full formation of latching hooks extending around the entire interior of the skirt, such that when the cover is placed on the container the cover latching hooks engage with the container latching ribs to secure the cover on the container. A tear strip may also be disposed on the cover skirt. Removal of the tear strip leaves residual flaps at each sidewall intersection and at about the lateral center of each sidewall. A portion of the cover skirt remains affixed to the container when the tear strip is removed.

DESCRIPTION OF THE DRAWINGS

The invention is best understood from the following detailed description when read with the accompanying drawings.

DETAILED DESCRIPTION OF THE INVENTION

Figure 1:
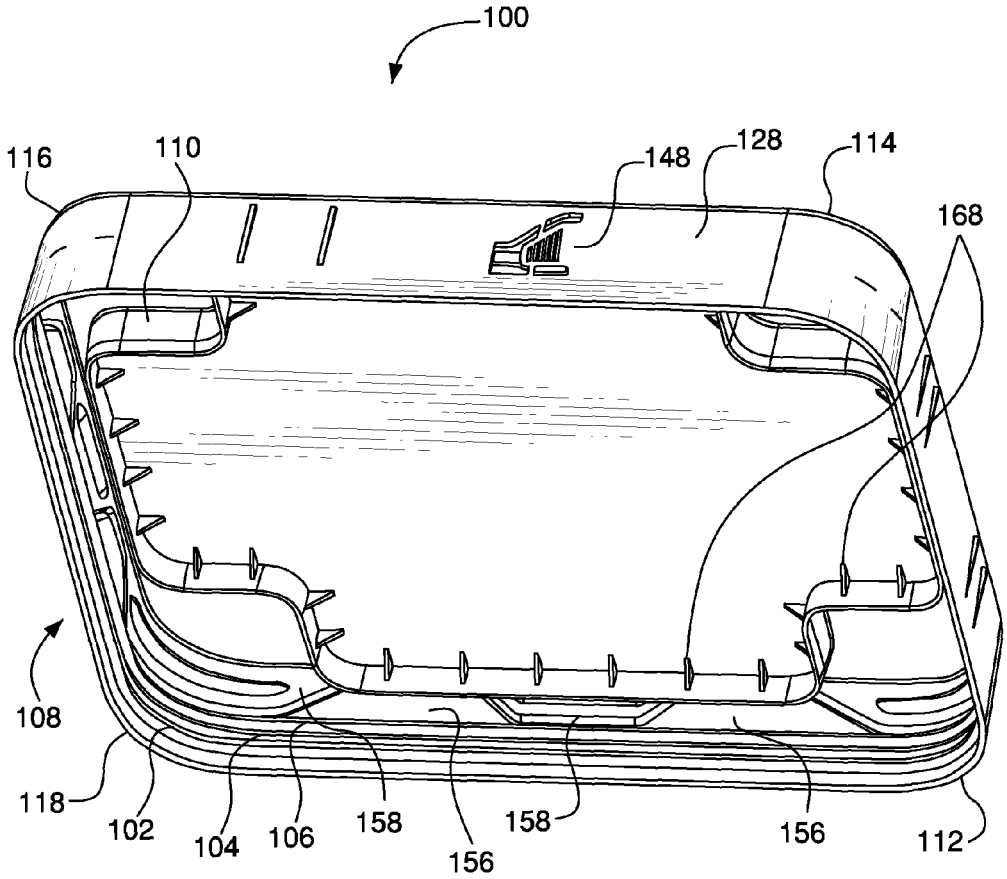
FIG. 1 shows the underside of a lid according to an illustrative embodiment of the invention.
Figure 2:
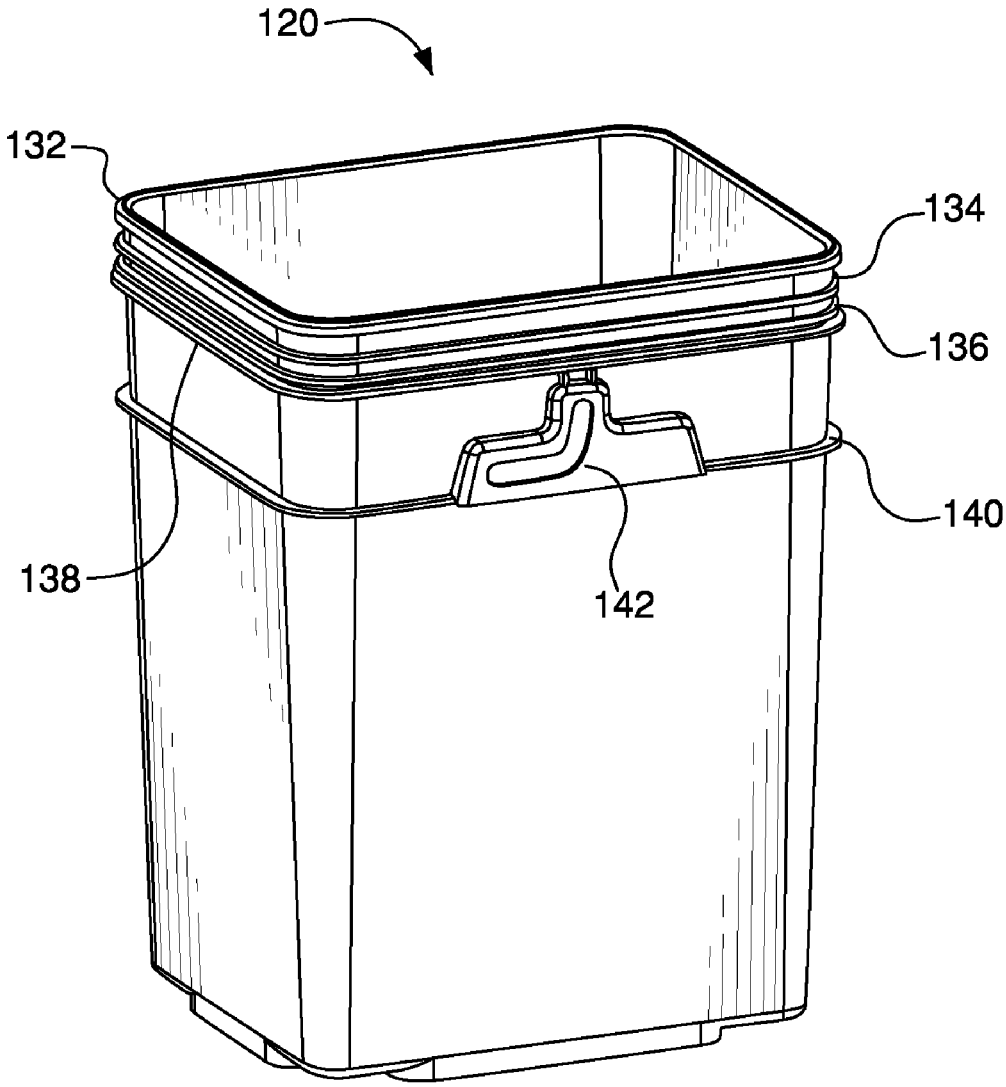
FIG. 2 shows a container according to an illustrative embodiment of the invention.
Figure 3:
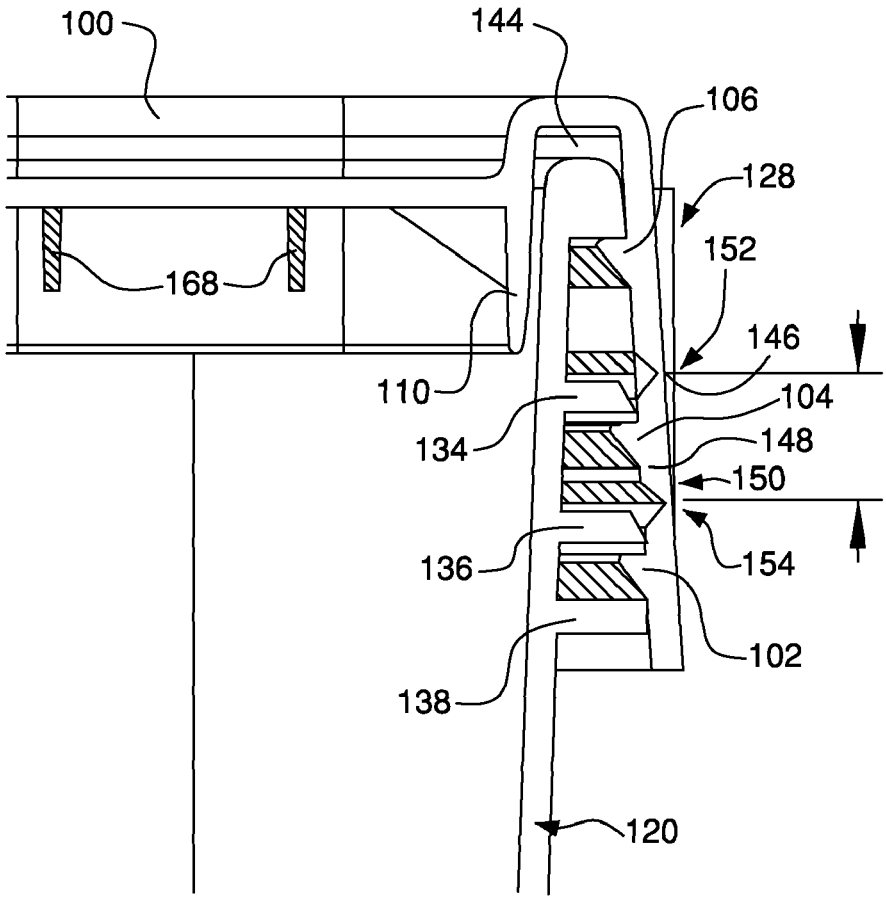
FIG. 3 shows a cross-section of a lid and container in an engagement position according to an illustrative embodiment of the invention.

FIG. 1 depicts a cover 100 according to an illustrative embodiment of the invention. An associated illustrative container 120 is depicted in FIG. 2. FIG. 3 depicts a cross section of cover 100 and container 120 in an engagement position according to an illustrative embodiment of the invention.

Cover 100 has features which permit cover latching ribs 102, 104, 106 on cover skirt 108 to be fully formed around each of the four corners 112, 114, 116, 118. In this particular embodiment, cover skirt 108 has an inner portion 110 and outer portion 128. The hoop strength necessary for consistent cover-to-container latching is found at the corners of the container because they are the stiffest portions. Inner cover skirt 110 may have support ribs 168 incorporated therein or otherwise fastened thereto. Inner cover skirt 110 is interrupted or offset inward toward the cover center at each of the four corners 112, 114, 116, 118 in a manner that permits the incorporation of a movable mold tooling in each corner. The use of a movable mold tooling to form each of the four corners of the cover permits the full formation of the axially staggered ribs or hooks 102, 104, 106 completely around each corner. These fully-formed corner ribs are key to the container's performance. Hooks 102, 104 and 106 interlock with flanges or latch rings 130, 132, 134 on the pail periphery to form the main, first and second interlocks. This provides three levels of cover-to-pail latching, adding an extra measure of security over standard single and dual latch pail and cover designs. Embodiments of the invention may also resolve or improve the leakage problems experienced with traditional designs of square or rectangular containers.

As shown in FIG. 2, a fourth ring 138 may be provided which functions as the tear strip retention ring. A fifth ring 140 can be provided at a lower distance from the three latch rings 132, 134, 136 to function as a stacking ring. Container 120 may also have one or more components such as pail ears 142, to which a handle may be attached. Handles may be, for example, hinged handles or foldaway handles.

A gasket channel 144 may be provided, preferably at the point where cover 100 meets the top of first latch ring 132 of the container body. Depending on the container and cover materials and the planned use of the container, a gasket, made for example from a rubber or rubber-like material, may be necessary to adequately seal the cover on the container.

If a tear strip 148 is incorporated into the cover, a protrusion 146 may be provided between hooks 102, 104 to create a seal once tear strip 148 is removed.

Embodiments of the invention also provide a cover having a unique tear strip 148. A tear strip 148 according to an illustrative embodiment of the invention, includes a central portion 150 that is removable by the user. Once removed, an uppermost portion 152 of the tear strip may be lifted to gain access to the contents. A lower most portion 154 of the tear strip remains attached to the container body and provides immediate visual evidence of tampering.

Optionally, tear strip 148 is an undulating tear strip, as shown in the figures. Removal of central portion 150 of the tear strip removes alternating segments 156 of the remaining cover skirt in a manner that leaves residual flaps 158, preferably at each of the four corners 112, 114, 116, 118 and/or centered at each of the sidewall locations. This provides the end user with easy access to the contents and enables the end user to reseal the container.

FIGS. 1-3 depict only an illustrative embodiment of the invention. Numerous variations, however, are within the spirit and scope of the invention. In a broad description the invention includes a container and cover with the following features. The container has a bottom and three or more sidewalls each extending upward from the bottom. The three or more sidewalls intersect one another to form an uninterrupted container boundary. Accordingly, although the container is preferably rectangular for most applications, it may have other geometric cross sections, such as hexagonal, triangular, etc. The shapes mentioned, however, do not necessarily indicate sharp corners at the intersection of the sidewalls. The intersections may be rounded as shown in FIGS. 1 and 2. The cover has sidewalls complimentary to the container sidewalls such that when the cover is placed on the container at least a portion of the cover sidewalls extends outside of the container sidewalls. By "complimentary" it is meant that the cover fits on the container. This complimentary fit preferably secures the cover onto the container, to at least some extent, without use of additional attachment mechanisms. The cross sectional profile of the cover does not necessarily exactly mirror that of the container. The cover and container must, at a minimum, complement one another to the extent that a seal is formed. The cover sidewalls have an inner cover skirt, which is an important feature of the invention.

The inner cover skirt is offset inward toward the cover interior at each sidewall-to-sidewall intersection. The offset is sufficient to permit use of a moveable mold tooling to form each of the corners of the cover, including formation of one or more latching features extending around each corner. The formation of the latching features around the corners can provide increased sealing capabilities as compared to traditional containers having angular cross sectional profiles.

The number of latching features disposed on the exterior of the container can vary. A single latching feature can be sufficient for some container applications, but generally additional latching features may be desirable. The latching features depicted in FIGS. 1-3 comprise simple hooks and rings. Other latching features, such as differently shaped hooks and rings can be used. Generally, the latching features should allow the cover to be snapped onto the container, as opposed to being twisted, and should be removable by prying with a tool or lifting by hand.

The latching features preferably are disposed completely around the container periphery for maximum sealing ability. It is possible, however, to form a lid and container wherein there are interruptions in the hooks and/or rings.

The importance of the invention is the ability to form latching features around the corners of the container. Although even containers having cross sectional shapes such a rectangles, have rounded corners, the radius of the corner is usually much smaller that the radius of a cylindrical container having a similar capacity. It is formation of latching features around these small radii that embodiments of the invention address. Illustrative corner radii ranges of at least one sidewall-to-sidewall intersection include, less than about 2 inches and less than about 1.5 inches. Additional illustrative corner radii ranges include about 0.5 inches to about 2.5 inches; about 1.0 inch to about 2.0 inches; and about 1.25 inches to about 1.75 inches.

Preferably the cover skirt has at least one portion extending into the interior of the container and at least one portion extending on the exterior of the container when the cover is positioned on the container to close the container as depicted in FIGS. 1 and 3.

The configuration of the optional tear strip can also vary. As noted above, the tear strip is preferably comprised of three portions. An upper portion remains on the cover skirt after removal of the tear strip, the lower portion remains on the container after removal of the tear strip, and the central portion is permanently removed. The purpose of having the lower portion remain is to provide visual evidence that there had been a tear strip, which is now removed. This can be important for safety reasons. The remainder of residual flaps after the tear strip is removed is also optional. The remaining flaps can, for example, provide additional latching capabilities, and therefore, be desirable.

Containers may be made of numerous materials. Embodiments of the invention, however, lend themselves to use of plastics, such as polypropylene, and high density polyethylene. Container size can also vary, but embodiments of the invention are particularly applicable to 1-7 gallon containers or pails, and may be of significant benefits for use with 5 gallon containers.

While the invention has been described by illustrative embodiments, additional advantages and modifications will occur to those skilled in the art. Therefore, the invention in its broader aspects is not limited to specific details shown and described herein. Modifications may be made without departing from the spirit and scope of the invention. Accordingly, it is intended that the invention not be limited to the specific illustrative embodiments, but be interpreted within the full spirit and scope of the claimed embodiments and their equivalents.

The invention claimed is:

1. A container and cover comprising:

a container having a bottom and three or more sidewalls each extending upward from the bottom, the three or more sidewalls intersecting one another to form an uninterrupted container boundary;

the container having one or more latching features disposed on the exterior of the container;

a cover having sidewalls complimentary to the container sidewalls such that when the cover is placed on the container at least a portion of the cover sidewalls extends outside of the container sidewalls;

the cover sidewalls having a skirt inner portion and a skirt outer portion; and wherein the skirt inner portion is offset inward toward the cover interior from the skirt outer portion along straight lengths of the sidewalls the straight lengths of the sidewalls disposed between curved corner portions, and the skirt inner portion is offset inward from the skirt outer portion throughout the curved corners of each sidewall-to-sidewall intersection a greater amount than the offset along the straight sidewalls, the offset sufficient to permit use of a moveable mold tooling to form each of the corners of the cover including formation of one or more latching features extending around each corner, such that when the cover is placed on the container the cover latching features engage with the container latching features to secure the cover on the container.

2. The container and cover of claim 1 further comprising a plurality of support ribs disposed around each corner of the cover.

3. The container and cover of claim 1 wherein the one or more latching features are disposed completely around the container periphery.

4. The container and cover of claim 1 wherein the corner radius of at least one sidewall-to-sidewall intersection is less than about 2 inches.

5. The container and cover of claim 1 wherein the corner radius of at least one sidewall-to-sidewall intersection is less than about 1.5 inches.

6. The container and cover of claim 1 wherein the corner radius of at least one sidewall-to-sidewall intersection is in a range of about 0.5 inches to about 2.5 inches.

7. The container and cover of claim 1 wherein the corner radius of at least one sidewall-to-sidewall intersection is in a range of about 1.0 inches to about 2.0 inches.

8. The container and cover of claim 1 wherein the corner radius of at least one sidewall-to-sidewall intersection is in a range of about 1.25 inches to about 1.75 inches.

9. The container and cover of claim 1 wherein the cover skirt has at least one portion extending into the interior of the container and at least one portion extending on the exterior of the container when the cover is positioned on the container to close the container.

10. The container and cover of claim 1 further comprising a tear strip disposed on the cover skirt.

11. The container and cover of claim 10 wherein the tear strip removes alternating segments of a portion of the tear strip such that residual flaps remain at each sidewall intersection.

12. The container and cover of claim 11 wherein residual flaps also remain at about the lateral center of each sidewall.

13. The container and cover of claim 10 wherein when the tear strip is removed a portion of the cover skirt remains affixed to the container.

14. The container and cover of claim 1 wherein the latching features on the cover are hooks and the latching features on the container are ribs.

15. The container and cover of claim 1 wherein the cover has a plurality of substantially parallel latching features disposed around the periphery of the cover skirt and the container has a plurality of substantially parallel latching features around the periphery of the exterior of the container such that when the cover is placed on the container, the cover latching features engage with the container latching features.

16. The container and cover of claim 1 further comprising a stacking ring disposed are around the container exterior.

17. The container and cover of claim 1 further comprising a hinged handle secured to the container.

18. The container and cover of claim 1 further comprising a gasket channel in the cover.

19. The container and cover of claim 1 wherein the container and cover are rectangular.

20. A container and lid comprising:

a rectangular container;

the container having three latching ribs and a tear strip retention rib disposed on the exterior of the container;

a rectangular cover complimentary to the container such that when the cover is placed on the container at least a portion of the cover sidewalls extends outside of the container sidewalls and a portion of the cover extends into the inside of the container;

the cover sidewalls having a skirt inner portion and a skirt outer portion; and wherein the skirt inner portion is offset inward toward the cover interior from the skirt outer portion along straight lengths of the sidewalls, the straight lengths of the sidewalls disposed between curved corner portions, and the skirt inner portion is offset inward from the skirt outer portion throughout the curved corners of each sidewall-to-sidewall intersection a greater amount than the offset along the straight sidewalls, the offset sufficient to permit use of a moveable mold tooling to form each of the corners of the cover including formation of three latching hooks extending around the entire interior of the skirt, such that when the cover is placed on the container the cover latching hooks engage with the container latching ribs to secure the cover on the container;

a tear strip disposed on the cover skirt, wherein the tear strip removes alternating segments of a portion of the tear strip such that residual flaps remain at each sidewall intersection and at about the lateral center of each sidewall, and wherein when the tear strip is removed a portion of the cover skirt remains affixed to the container.

* * * * *